US006971712B1

(12) United States Patent
Tseng

(10) Patent No.: US 6,971,712 B1
(45) Date of Patent: Dec. 6, 2005

(54) RETRACTABLE FURNITURE DEVICE

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 11/138,181

(22) Filed: May 26, 2005

(51) Int. Cl.[7] ..... A47C 3/029
(52) U.S. Cl. ..... 297/32; 297/16.1
(58) Field of Search ..... 297/16.1, 29, 32, 297/46, 48, 51, 52, 271.6; 108/118, 132

(56) References Cited

U.S. PATENT DOCUMENTS 221,062 A * 10/1879 Hayes ..... 297/32
247,562 A * 9/1881 Hayes ..... 297/32
284,822 A * 9/1883 Cotton ..... 297/32
297,809 A * 4/1884 Jones ..... 297/20
1,264,309 A * 4/1918 Lard ..... 297/32
4,008,918 A * 2/1977 Cooper et al. ..... 297/16.1
6,332,646 B1 * 12/2001 Tseng ..... 297/16.1
6,840,573 B1 * 1/2005 Yao ..... 297/16.1
6,883,862 B1 * 4/2005 Yao ..... 297/16.1

* cited by examiner

*Primary Examiner*—Peter R. Crown
(74) *Attorney, Agent, or Firm*—Ladas & Parry LLP

(57) ABSTRACT

A retractable furniture device includes two supporting units for supporting a seat frame on a base frame. Each supporting unit includes an inclined first support member connected pivotally between a rear end portion of a curved lateral rod of the base frame and a front frame portion of the seat frame, a foldable second support member connected pivotally between a front end portion of the lateral rod and a rear frame portion of the seat frame, and a foldable retracting control member interconnecting pivotally the first and second support members. The retracting control members and the second support members can be folded such that the supporting units are superposed between the base frame and the seat frame.

4 Claims, 5 Drawing Sheets

RETRACTABLE FURNITURE DEVICE

BACKGROUND OF THE INVENTION

1. Field of the Invention

The invention relates to a furniture device, more particularly to a retractable furniture device, such as a retractable rocking chair.

2. Description of the Related Art

Conventional rocking chairs are generally designed to have a non-retractable structure with a relatively large size. As such, the conventional rocking chair is inconvenient to transport and store. In order to solve the drawback of the conventional rocking chair, it is desirable to design a retractable rocking chair.

SUMMARY OF THE INVENTION

Therefore, the object of the present invention is to provide a retractable furniture device that facilitates storage and transport.

According to the present invention, a retractable furniture device comprises:

- a seat frame having opposite front and rear frame portions;
- a base frame disposed under the seat frame and including two curved lateral rods, each of which has opposite front and rear end portions; and
- two supporting units for supporting the seat frame on the base frame, each of the supporting units including
  - an inclined elongate first support member connected pivotally between the rear end portion of a corresponding one of the lateral rods of the base frame and the front frame portion of the seat frame,
  - a foldable second support member having a first rod section connected pivotally to the front end portion of the corresponding one of the lateral rods of the base frame at one end, a second rod section connected pivotally to the rear frame portion of the seat frame at one end, and a third rod section having two opposite ends connected respectively and pivotally to the other end of the first rod section and the other end of the second rod and connected pivotally to an intermediate portion of the first support member, and
  - a foldable retracting control member having a first coupling end connected pivotally to the first support member and disposed between the third rod section of the second support member and the rear end portion of the corresponding one of the lateral rods of the base frame, and a second coupling end opposite to the first coupling end and connected pivotally to a junction of the first and third rod sections of the second support member.

The furniture device is operable so as to change between an expanded state, where the retracting control member of each of the supporting units is unfolded and is spaced apart from the corresponding one of the lateral rods of the base frame and where the second support member of each of the supporting units is unfolded and extends upwardly and rearwardly from the front end portion of the corresponding one of the lateral rods of the base frame, and a retracted state, where the retracting control member and the second support member of each of the supporting units are folded and are proximate to the corresponding one of the lateral rods of the base frame such that the supporting units are superposed between the base frame and the seat frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
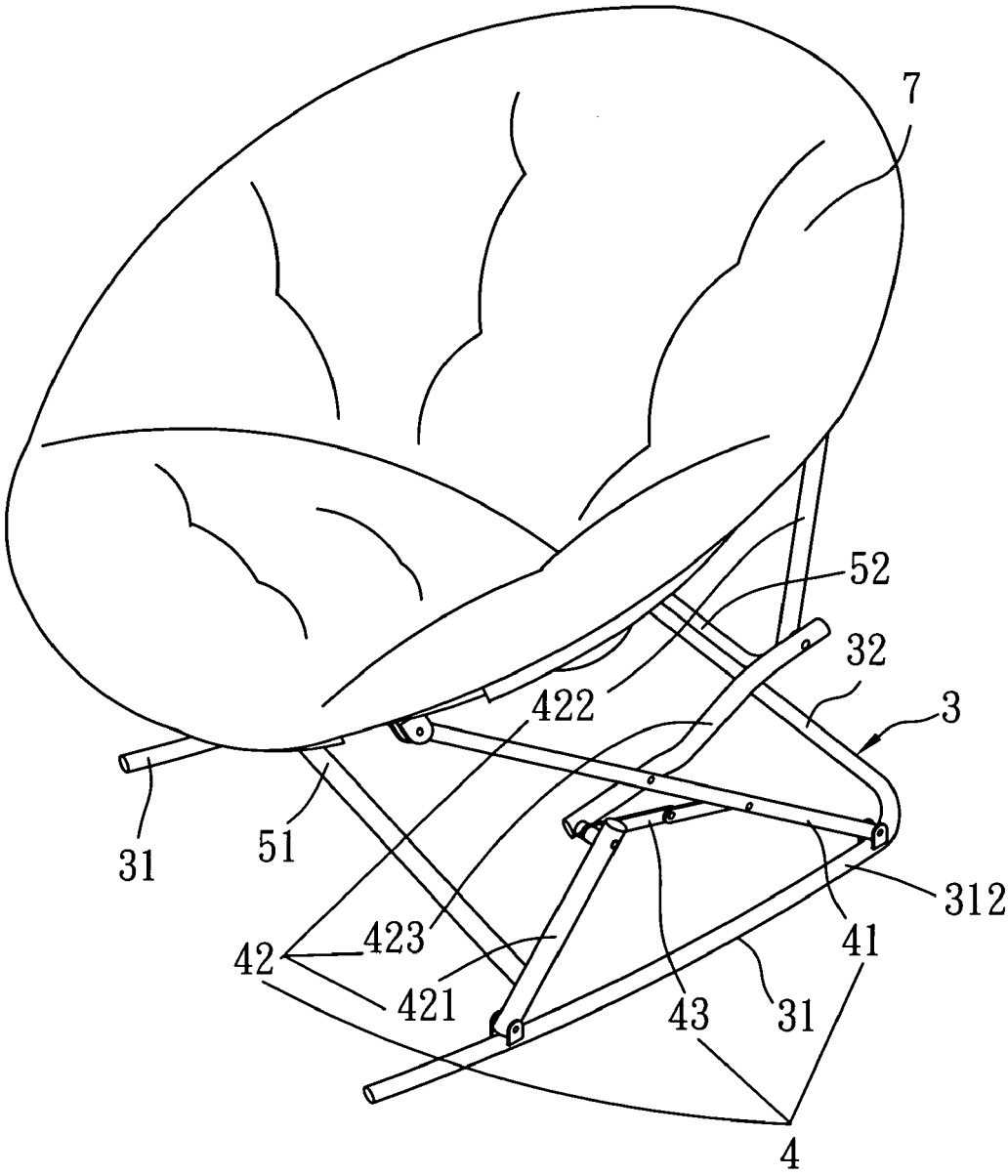
FIG. 1 is a perspective view showing the preferred embodiment of a retractable furniture device according to the present invention when in an expanded state.
Figure 2:
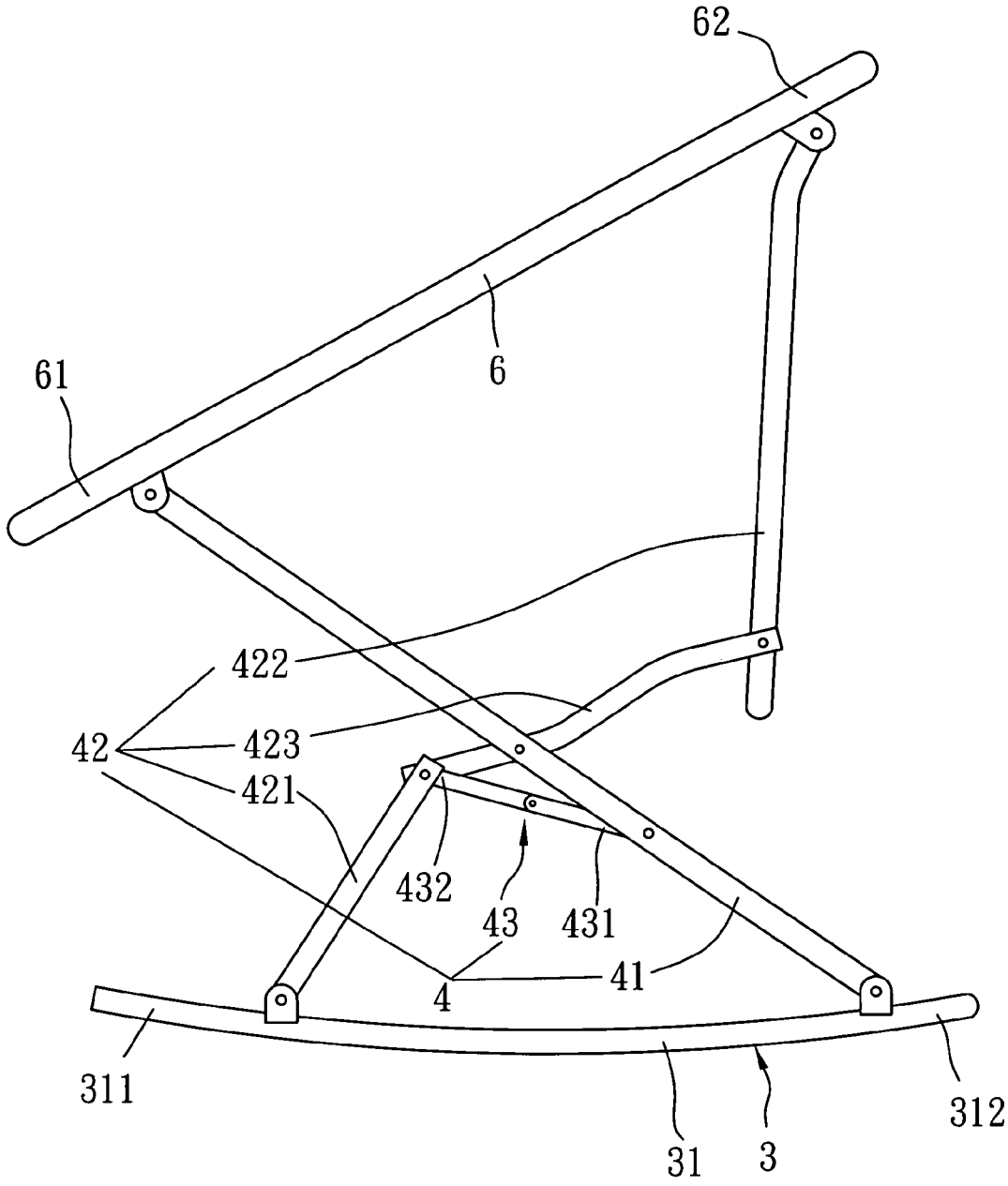
FIG. 2 is a schematic side view of the preferred embodiment, wherein a pliable bag is removed.

Referring to FIGS. 1 and 2, the preferred embodiment of a retractable furniture device according to the present invention is shown to be embodied in a rocking chair that includes a seat frame 6, a base frame 3, and two supporting units 4.

The seat frame 6 has opposite front and rear frame portions 61, 62. In this embodiment, the seat frame 6 is formed as a ring (see FIG. 5), and is mounted with a pliable bag 7. The ring-shaped seat frame 6 and the pliable bag 7 cooperatively form a combined seat and backrest unit of a chair.

Figure 5:
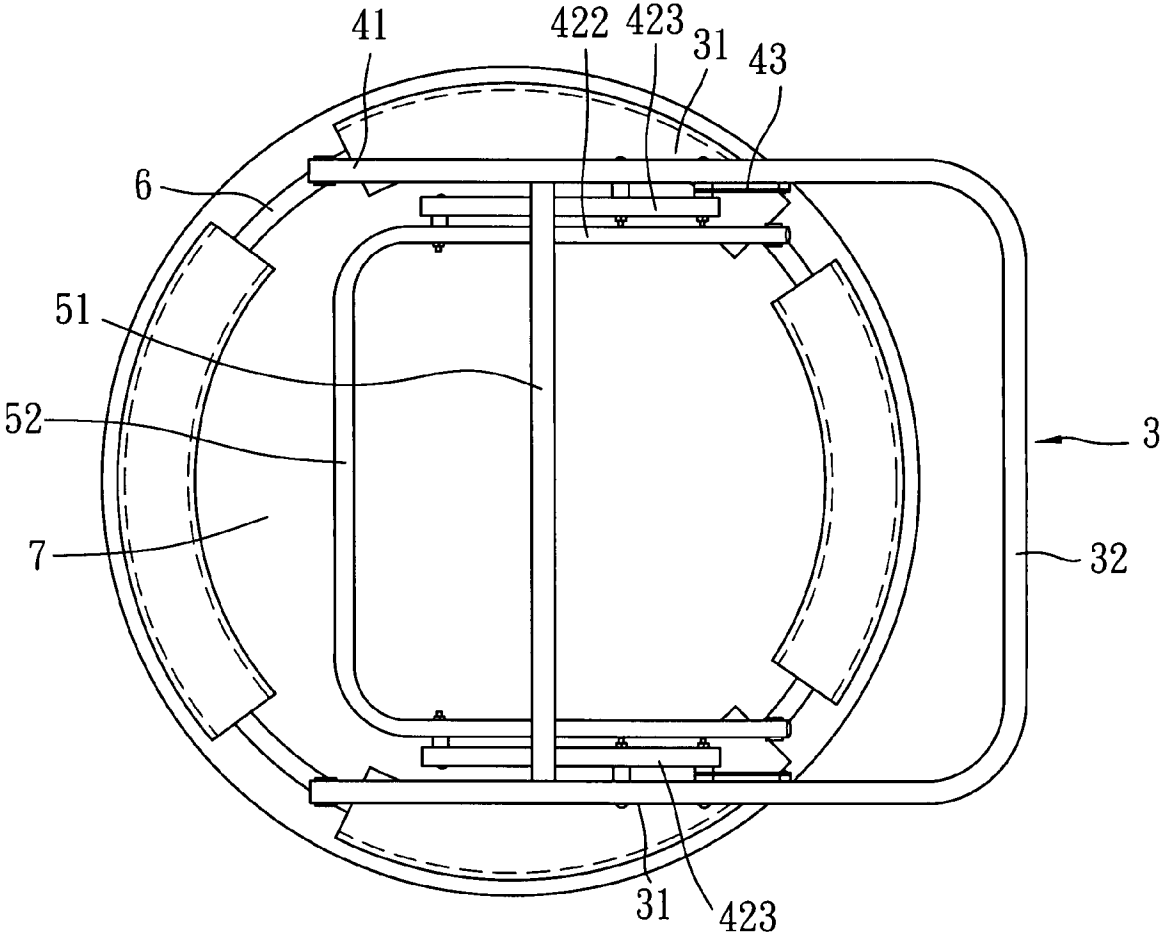
FIG. 5 is a schematic bottom side view showing the preferred embodiment when in the retracted state.

The base frame 3 is disposed under the seat frame 6, and includes opposite curved lateral rods 31, each of which has two spaced-apart front and rear end portions 311, 312. In this embodiment, the base frame 3 further includes a rear rod 32 interconnecting fixedly the rear end portions 312 of the lateral rods 31, as shown in FIGS. 1 and 5.

The supporting units 4 support the seat frame 6 on the base frame 3. Each supporting unit 4 includes an inclined elongate first support member 4, a foldable second support member 42, and a foldable retracting control member 43.

The first support member 41 is connected pivotally between the rear end portion 312 of a corresponding one of the lateral rods 31 of the base frame 3 and the front frame portion 61 of the seat frame 6.

The foldable second support member 42 has a first rod section 421 connected pivotally to the front end portion 311 of the corresponding one of the lateral rods 31 of the base frame 3 at one end, a second rod section 422 connected pivotally to the rear frame portion 62 of the seat frame 6 at one end, and a third rod section 423 having two opposite ends connected respectively and pivotally to the other end of first rod section 421 and the other end of the second rod section 422 and connected pivotally to an intermediate portion of the first support member 41.

The retracting control member 43 has a first coupling end 431 connected pivotally to the first support member 41 and disposed between the third rod section 423 of the second support member 42 and the rear end portion 312 of the corresponding one of the lateral rods 31 of the base frame 3, and a second coupling end 432 opposite to the first coupling end 431 and connected pivotally to a junction of the first and third rod sections 421, 423 of the second support member 42.

In this embodiment, the rocking chair further includes a first connecting rod 51 interconnecting fixedly the first rod sections 421 of the second support member 42, as best shown in FIG. 1, and a second connecting rod 52 interconnecting fixedly the second rod sections 422 of the second support members 42, as best shown in FIG. 5.

Figure 4:
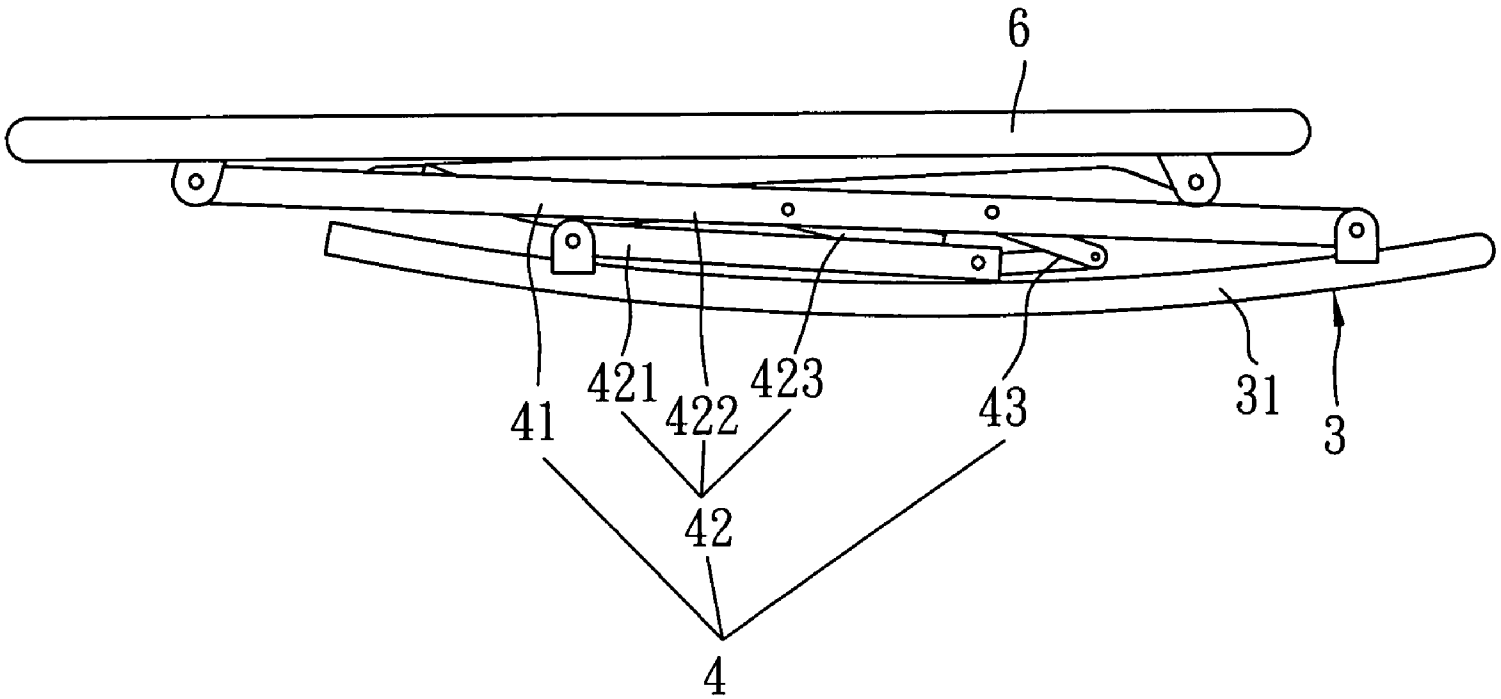
FIG. 4 is a schematic side view showing the preferred embodiment of FIG. 2 when in a retracted state.

With such a configuration, the retractable rocking chair is operable so as to change between expanded and retracted states. In the expanded state as shown in FIGS. 1 and 2, the retracting control member 43 of each of the supporting units 4 is unfolded and is spaced apart from the corresponding one of the lateral rods 31 of the base frame 3. That is, the second support member 42 of each of the supporting units 4 is unfolded and extends upwardly and rearwardly from the front end portion 311 of the corresponding one of the lateral rods 31 of the base frame 3. In the retracted state as shown in FIG. 4, the retracting control member 43 and the second support member 42 of each of the supporting units 4 are folded, and are proximate to the corresponding one of the lateral rods 31 of the base frame 3 such that the supporting units 4 are superposed between the base frame 3 and the seat frame 6. As a result, the rocking chair in the retracted state has a minimized size, thereby facilitating storage and transport.

Figure 3:
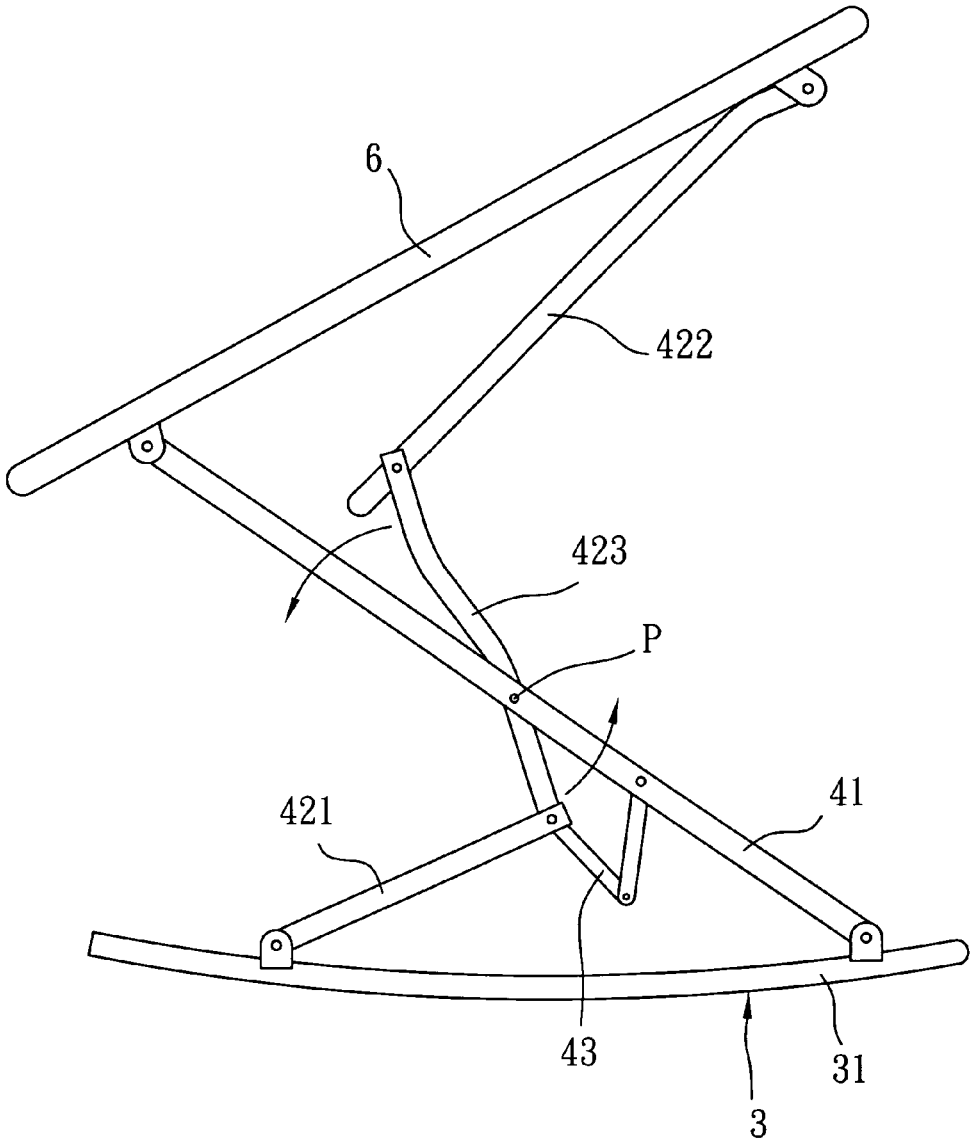
FIG. 3 is a schematic side view illustrating how the preferred embodiment is changed from the expanded state to a semi-retracted state.

In actual operation, by pressing downwardly a middle portion of the retracting control member 43, the rocking chair can be easily changed from the expanded state to the retracted state. During the transition from the expanded state to the retracted state, the first support member 41 is rotatable about a junction (P) (see FIG. 3) of the first support member 41 and the third rod section 423 of the second support member 42 in a counterclockwise direction indicated by the arrows in FIG. 3. Subsequently, the seat frame 6 is pressed downwardly such that the rocking chair is changed to the retracted state.

It is noted that, when a user sits on the rocking chair in the expanded state, the retracting control members 43 are maintained in their unfolded state due to the weight of the user so as to prevent unintentional folding of the retracting control members 43, thereby ensuring safety during use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A retractable furniture device comprising:

a seat frame having opposite front and rear frame portions;

a base frame disposed under said seat frame and including opposite curved lateral rods, each of which has two front and rear end portions; and two supporting units for supporting said seat frame on said base frame, each of said supporting units including an inclined elongate first support member connected pivotally between said rear end portion of a corresponding one of said lateral rods of said base frame and said front frame portion of said seat frame, a foldable second support member having a first rod section connected pivotally to said front end portion of the corresponding one of said lateral rods of said base frame at one end, a second rod section connected pivotally to said rear frame portion of said seat frame at one end, and a third rod section having two opposite ends connected respectively and pivotally to the other end of said first rod section and the other end of said second rod and connected pivotally to an intermediate portion of said first support member, and a foldable retracting control member having a first coupling end connected pivotally to said first support member and disposed between said third rod section of said second support member and said rear end portion of the corresponding one of said lateral rods of said base frame, and a second coupling end opposite to said first coupling end and connected pivotally to a junction of said first and third rod sections of said second support member;

said furniture device being operable so as to change between an expanded state, where said retracting control member of each of said supporting units is unfolded and is spaced apart from the corresponding one of said lateral rods of said base frame and where said second support member of each of said supporting units is unfolded and extends upwardly and rearwardly from said front end portion of the corresponding one of said lateral rods of said base frame, and a retracted state, where said retracting control member and said second support member of each of said supporting units are folded and are proximate to the corresponding one of said lateral rods of said base frame such that said supporting units are superposed between said base frame and said seat frame.

2. The retractable furniture device as claimed in claim 1, wherein said base frame further includes a rear rod interconnecting fixedly said rear end portions of said lateral rods.

3. The retractable furniture device as claimed in claim 1, further comprising:

a first connecting rod interconnecting fixedly said first rod sections of said second support members; and a second connecting rod interconnecting fixedly said second rod sections of said second support members.

4. The retractable furniture device as claimed in claim 1, wherein said seat frame is shaped as a ring, and is mounted with a pliable bag, said seat frame and said pliable bag cooperatively forming a combined seat and backrest unit of a chair.

* * * * *